US010699858B2

(12) United States Patent
Chang et al.

(10) Patent No.: US 10,699,858 B2
(45) Date of Patent: Jun. 30, 2020

(54) KEYBOARD DEVICE

(71) Applicant: Primax Electronics Ltd., Taipei (TW)

(72) Inventors: Sheng-Fan Chang, Taipei (TW); Che-An Li, Taipei (TW); Ding-Hsiang Pan, Taipei (TW); Chia-Feng Lee, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 16/189,861

(22) Filed: Nov. 13, 2018

(65) Prior Publication Data

US 2019/0221385 A1 Jul. 18, 2019

(30) Foreign Application Priority Data

Jan. 12, 2018 (TW) ..... 107101272 A

(51) Int. Cl.

| | |
|---|---|
| ***H01H 13/88*** | (2006.01) |
| ***H01H 13/14*** | (2006.01) |
| ***H01H 13/7065*** | (2006.01) |
| ***H01H 3/12*** | (2006.01) |
| ***H01H 13/84*** | (2006.01) |

(52) U.S. Cl.

CPC ..... *H01H 13/88* (2013.01); *H01H 3/125* (2013.01); *H01H 13/14* (2013.01); *H01H 13/7065* (2013.01); *H01H 13/84* (2013.01); *H01H 2215/03* (2013.01)

(58) Field of Classification Search

CPC ..... H01H 13/88; H01H 3/125; H01H 13/14; H01H 13/7065

USPC ..... 200/344

See application file for complete search history.

(56) References Cited

U.S. PATENT DOCUMENTS

| | | | | |
|---|---|---|---|---|
| 8,592,702 | B2 * | 11/2013 | Tsai | G06F 3/0202 200/296 |
| 2015/0101916 | A1 * | 4/2015 | Chen | H01H 3/125 200/5 A |
| 2016/0284488 | A1 * | 9/2016 | Zhang | H01H 13/023 |

* cited by examiner

*Primary Examiner* — Edwin A. Leon
*Assistant Examiner* — Lheiren Mae A Caroc
(74) *Attorney, Agent, or Firm* — Kirton McConkie; Evan R. Witt

(57) ABSTRACT

The present invention provides a keyboard device, including a plurality of keys, thin film circuit boards, and key bottom plates. A connection component of the key is connected between a keycap of the key and a bottom plate connection portion of key bottom plate, and the bottom plate connection portion has a connection portion surface corresponding to the keycap and a raised portion formed on the connection portion surface. When the keycap moves downward relative to the thin film circuit board, a lower surface of the keycap knocks the raised portion.

9 Claims, 10 Drawing Sheets

KEYBOARD DEVICE

FIELD OF THE INVENTION

The present invention relates to the field of input devices, and in particular, to a keyboard device.

BACKGROUND OF THE INVENTION

A common computer peripheral input device includes a mouse device, a keyboard device, a trackball device, and the like. The keyboard device may allow a user to directly input characters and symbols to a computer and therefore, attracts much attention.

A structure and functions of a conventional keyboard device are first described. Referring to FIG. 1 to FIG. 4, FIG. 1 is a schematic diagram of an appearance structure of a conventional keyboard device. FIG. 2 is a schematic three-dimensional exploded diagram of a part of a structure of the keyboard device shown in FIG. 1. FIG. 3 is a three-dimensional exploded view of a part of a structure of the keyboard device shown in FIG. 1 from any viewing angle. FIG. 4 is a schematic cross-section diagram of a part of a structure of the keyboard device shown in FIG. 1. For clearness, only one key and related component structures are shown in FIG. 1 to FIG. 4 and FIG. 5 in the following, but the quantity does not impose a limitation in an actual application. A keyboard device 1 includes a plurality of keys 10, key bottom plates 11, and thin film circuit boards 12 disposed between the keys 10 and the key bottom plates 11. Each key 10 includes a keycap 101, a connection component 102, and an elastomer 103. The connection component 102 is connected between the keycap 101 and the key bottom plate 11, so that the keycap 101 can vertically move relative to the key bottom plate 11. The elastomer 103 is disposed between the keycap 101 and the key bottom plate 11 and has an abutting portion 1031. In addition, the connection component 102 is a scissors-type connection component and includes a first frame 1021 and a second frame 1022 pivotally connected to the first frame 1021, and each keycap 101 includes a keycap buckling portion 1011 and a keycap hooking portion 1012.

Secondly, the key bottom plate 11 includes a first hook 111 and a second hook 112 of a thin film penetrating hole 125 extending upward and penetrating the thin film circuit board 12. One end of the first frame 1021 is connected to the keycap hooking portion 1012 of the keycap 101, and the other end is connected to the second hook 112 of the key bottom plate 11. One end of the second frame 1022 is connected to the keycap buckling portion 1011 of the keycap 101, and the other end is connected to the first hook 111 of the key bottom plate 11. Based on the foregoing structural design, the first frame 1021 and the second frame 1022 can swing relative to each other to be converted from a superimposed state to a separated state or from a separated state to a superimposed state.

Thirdly, the thin film circuit board 12 includes a plurality of thin film switches 121. Referring to FIG. 5 as well, FIG. 5 is a schematic cross-section diagram of a part of a structure of the keyboard device shown in FIG. 1 after the keyboard device is pressed by a keycap. The thin film circuit board 12 includes the plurality of thin film switches 121. When a keycap 101 of any key 10 is pressed to move downward relative to the key bottom plate 11, the first frame 1021 and the second frame 1022 of the connection component 102 change from the separated state to the superimposed state, and the keycap 101 moving downward extrudes the elastomer 103, so that an abutting portion 1031 of the elastomer 103 abuts against and presses the corresponding thin film switch 121, so as to conduct the corresponding thin film switch, so that the keyboard device 1 generates a corresponding key signal. When the keycap 101 of the key 10 is no longer pressed, the keycap 101 moves upward relative to the key bottom plate 11 due to an elastic force of the elastomer 103. In this case, the first frame 1021 and the second frame 1022 change from the superimposed state to the separated state, and the keycap 101 recovers to an original position.

It should be noted that in a process that the keycap 101 of the key 10 is pressed, a lower surface 1013 of the keycap 101 impacts the connection component 102 and makes a knocking sound. The lower surface 1013 of the keycap 101 also impacts the first hook 111 and the second hook 112 of the key bottom plate 11 so as to make a knocking sound. The keycap 101 and the connection component 102 are both made of a plastic material. Therefore, a knocking sound made by impact of the keycap 101 and the connection component 102 is extremely small. Although the first hook 111 and the second hook 112 of the key bottom plate 11 are made of a metal material, a surface 1111, used for contacting with the key bottom plate 11, on the first hook 111 and a surface 1121, used for contacting with the key bottom plate 11, on the second hook 112 are both smooth surfaces (as shown in dashed line boxes in FIG. 5). Therefore, after the keycap 101 is pressed, the lower surface 1013 of the keycap 101 impacts with the first hook 111 and the second hook 112 face to face. Therefore, the knocking sound that can be made is also quite limited. However, because a sound that can be made by the keyboard device 1 after the keycap 101 of the key 10 is pressed is so small as not to satisfy operation feedback of particular users, especially users of game and e-sports groups.

According to the foregoing descriptions, a conventional keyboard device needs to be improved.

SUMMARY OF THE INVENTION

A main objective of the present invention is to provide a keyboard device whose keycap can make an effective sound after being pressed, so as to satisfy operation feedback of users.

In a preferred embodiment, the present invention provides a keyboard device, including:

a thin film circuit board, including a thin film switch;

a key, including:

a keycap, located above the thin film circuit board and including a first keycap connection portion and a second keycap connection portion, where the keycap is used to move downward relative to the thin film circuit board so as to conduct the thin film switch; and a connection component, including a first frame and a second frame used to swing relative to the first frame, where one end of the first frame is connected to the first keycap connection portion, and one end of the second frame is connected to the second keycap connection portion; and a key bottom plate, including a base plate, a first bottom plate connection portion, and a second bottom plate connection portion, where the first bottom plate connection portion extends upward from the base plate and is used to connect to the other end of the second frame, and the second bottom plate connection portion extends upward from the base plate and is used to connect to the other end of the first frame;

the first bottom plate connection portion has a first connection portion surface and a first raised portion, the first connection portion surface corresponds to a lower surface of the keycap, and the first raised portion is formed on the first connection portion surface, so that when the keycap moves downward relative to the thin film circuit board, the lower surface of the keycap knocks the raised portion.

DETAILED DESCRIPTION OF THE PREFERRED EMBODIMENT

Figure 1:
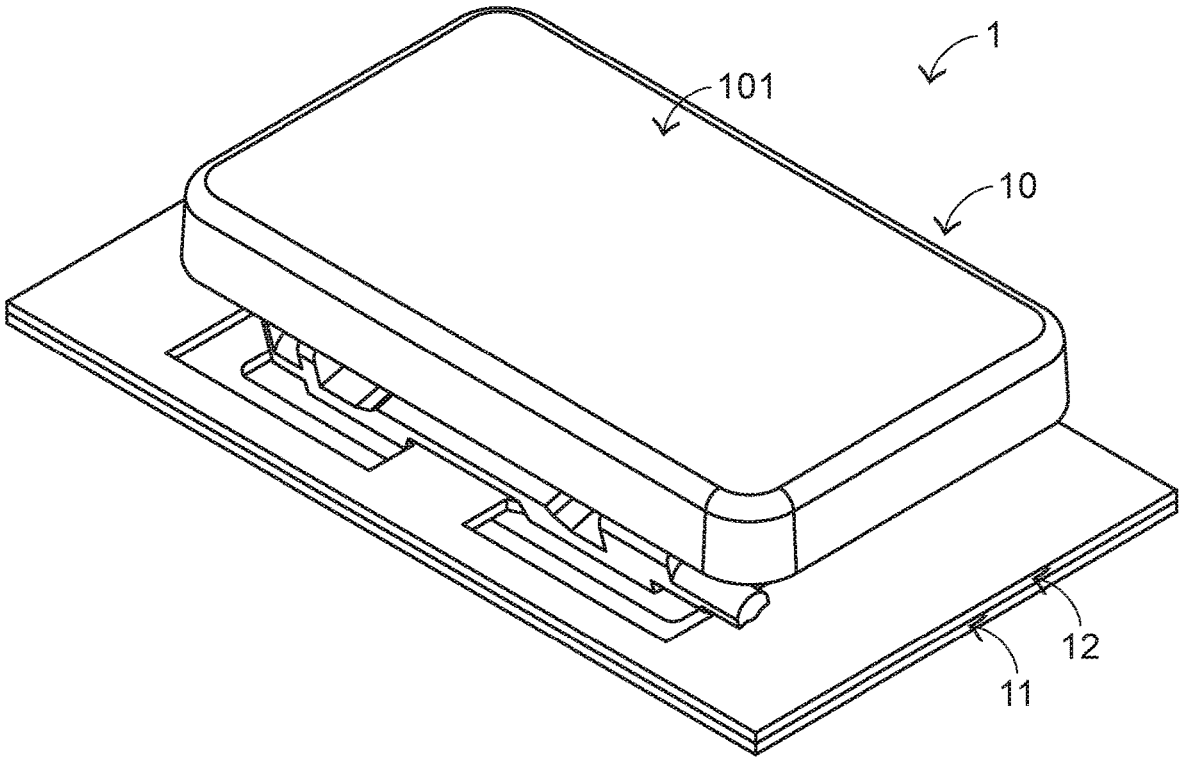
FIG.1 PRIOR ART
FIG. 1 is a schematic diagram of an appearance structure of a conventional keyboard device.
Figure 2:
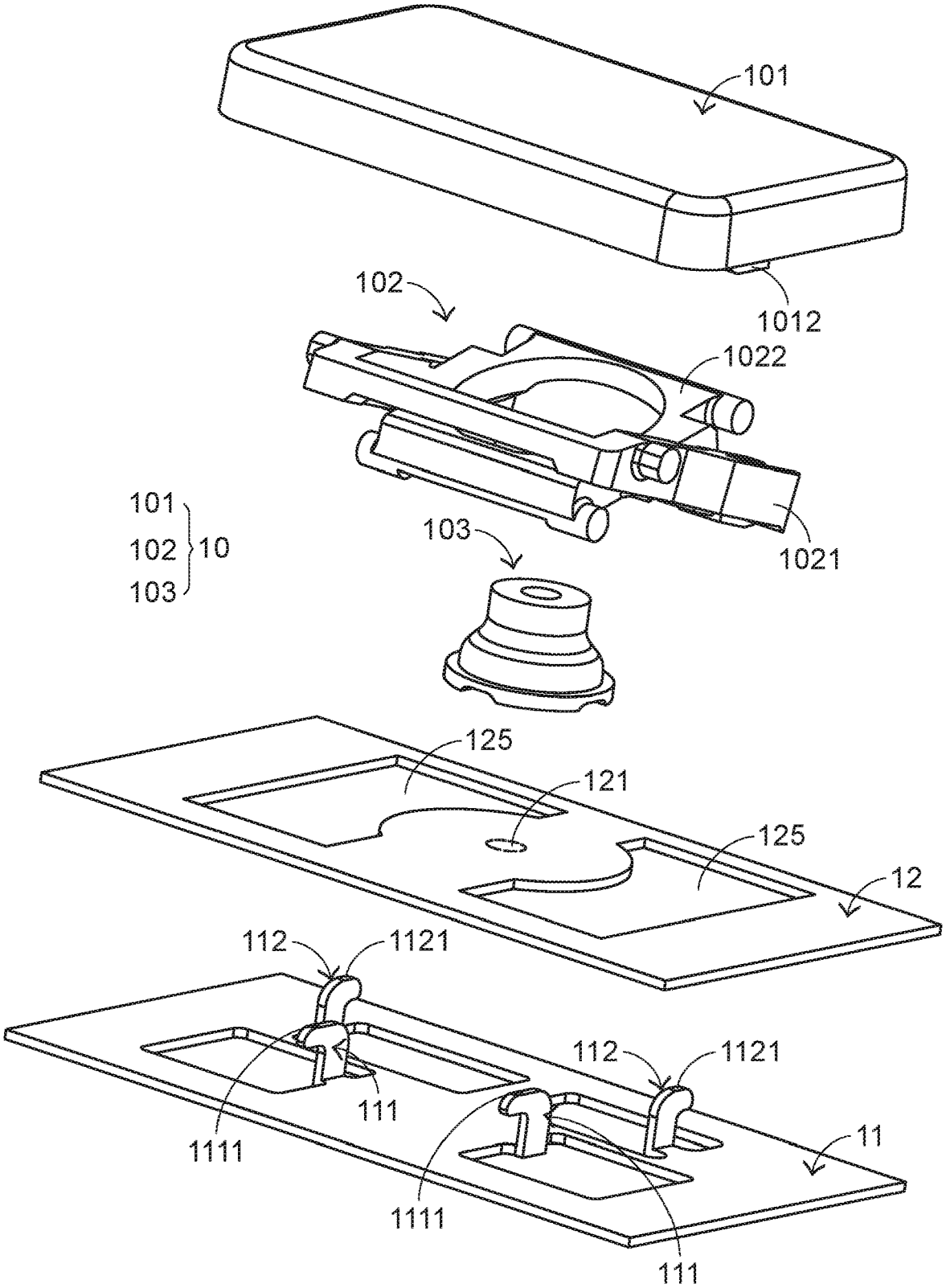
FIG.2 PRIOR ART
FIG. 2 is a schematic three-dimensional exploded diagram of a part of a structure of the keyboard device shown in FIG. 1.
Figure 3:
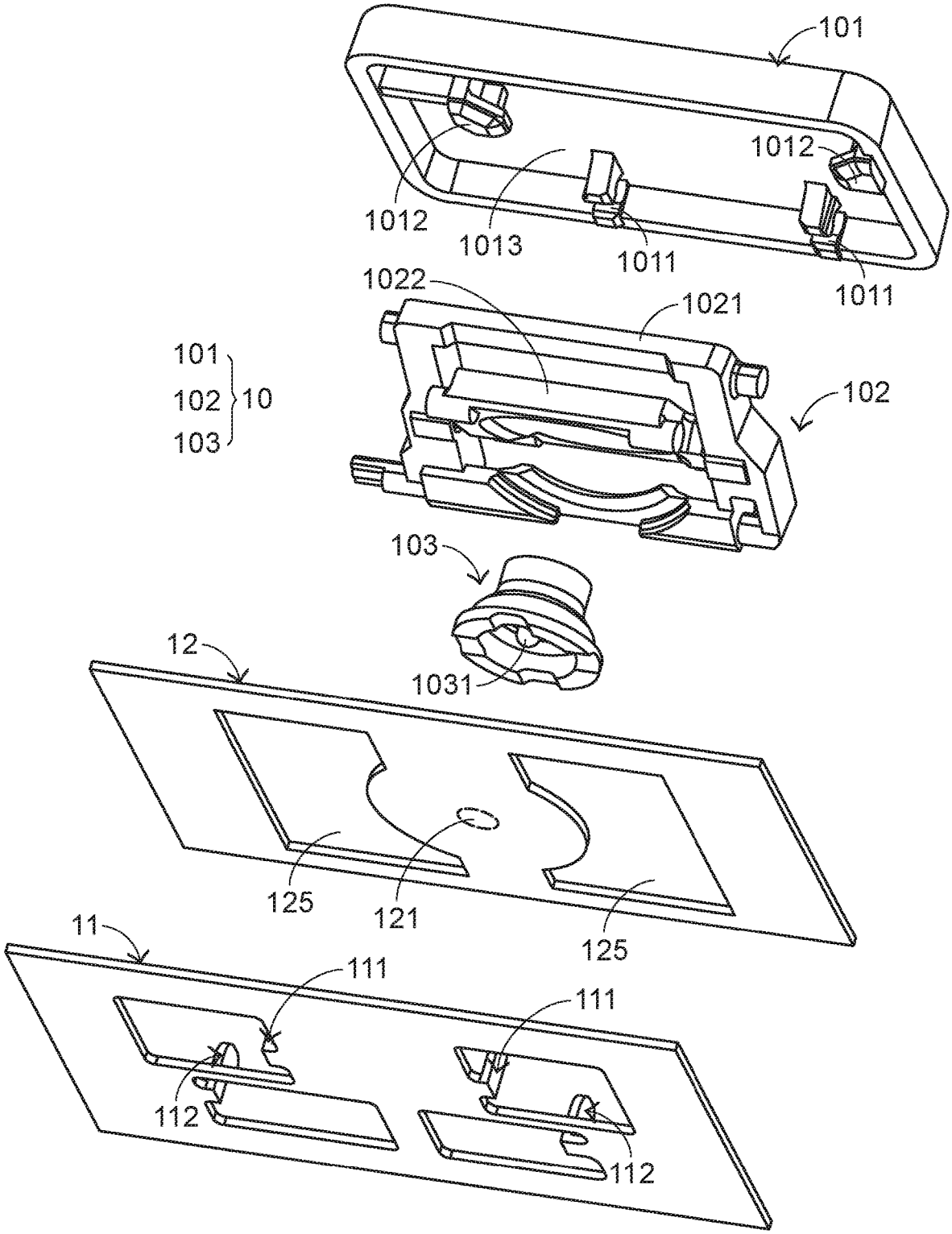
FIG.3 PRIOR ART
FIG. 3 is a three-dimensional exploded view of a part of a structure of the keyboard device shown in FIG. 1 from any viewing angle.
Figure 4:
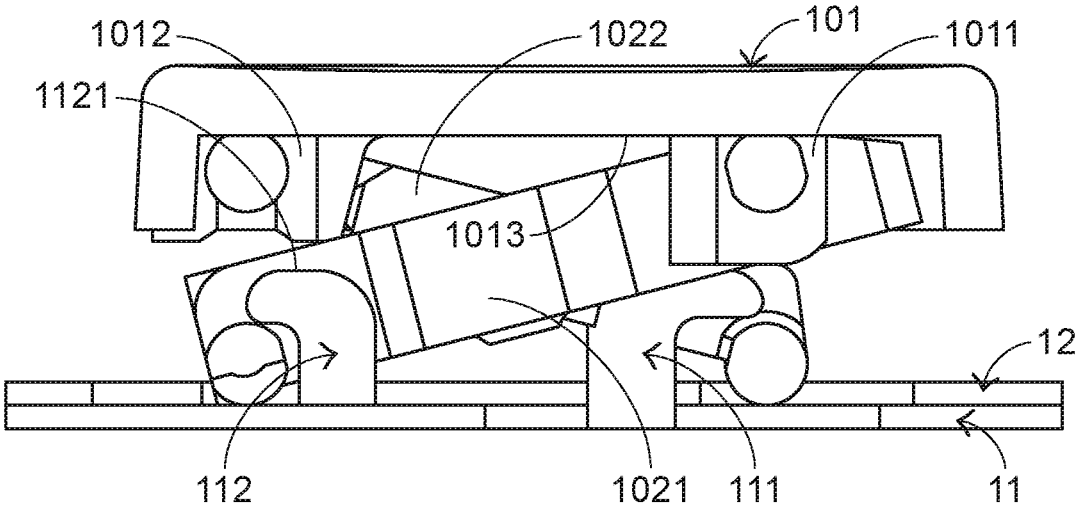
FIG.4 PRIOR ART
FIG. 4 is a schematic cross-section diagram of a part of a structure of the keyboard device shown in FIG. 1.
Figure 5:
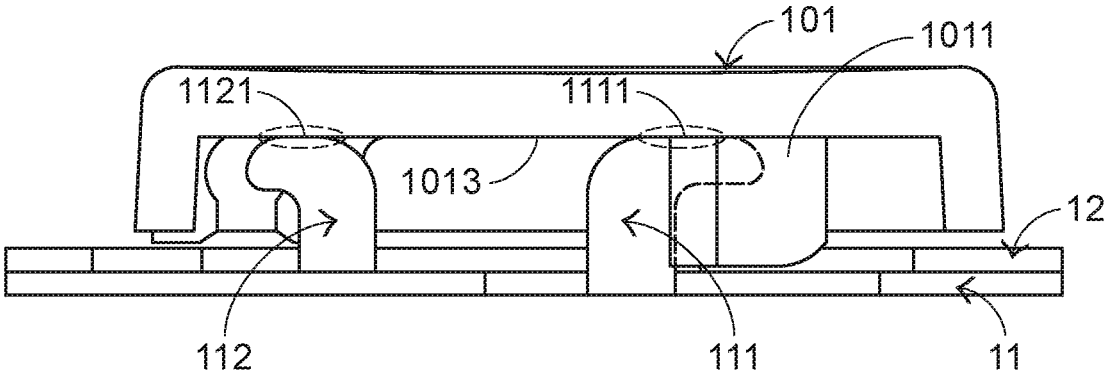
FIG.5 PRIOR ART
FIG. 5 is a schematic cross-section diagram of a part of a structure of the keyboard device shown in FIG. 1 after the keyboard device is pressed by a keycap.
Figure 6:
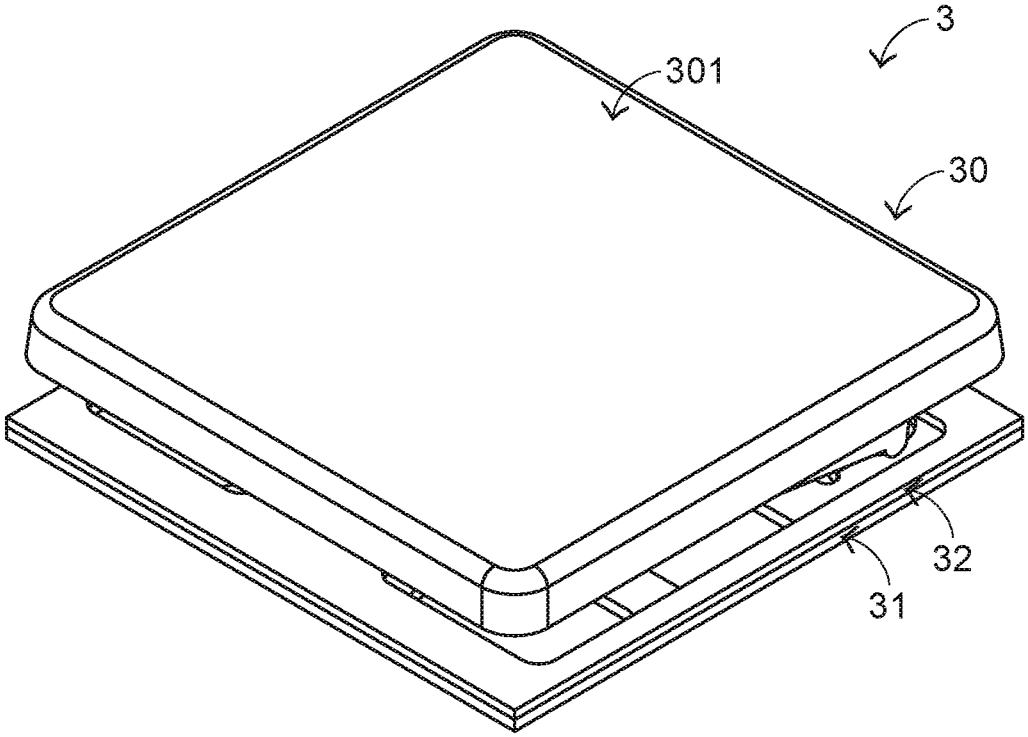
FIG. 6 is a schematic diagram of an appearance structure of a keyboard device in a first preferred embodiment according to the present invention.
Figure 7:
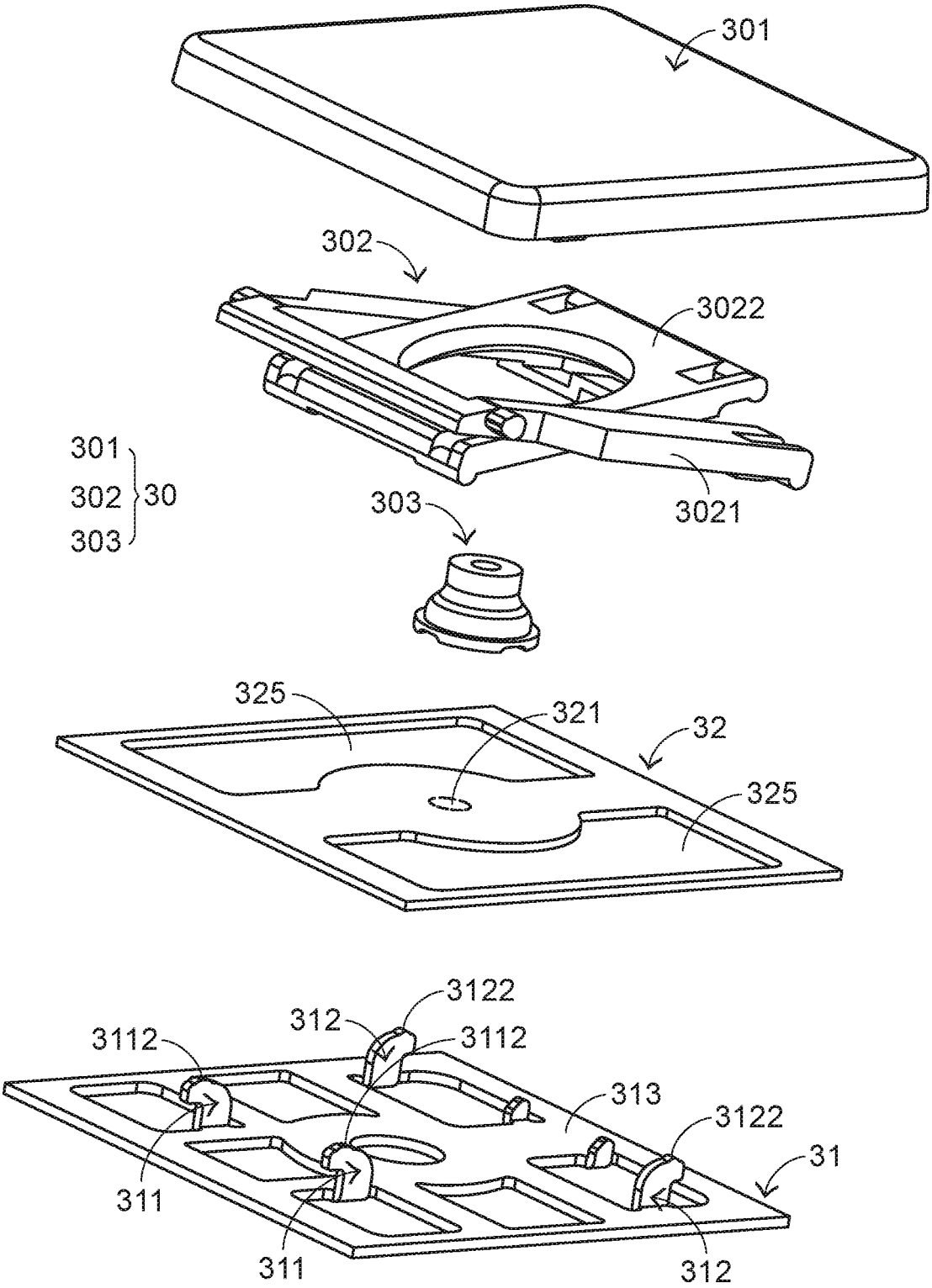
FIG. 7 is a schematic three-dimensional exploded diagram of a part of a structure of the keyboard device shown in FIG. 6.
Figure 8:
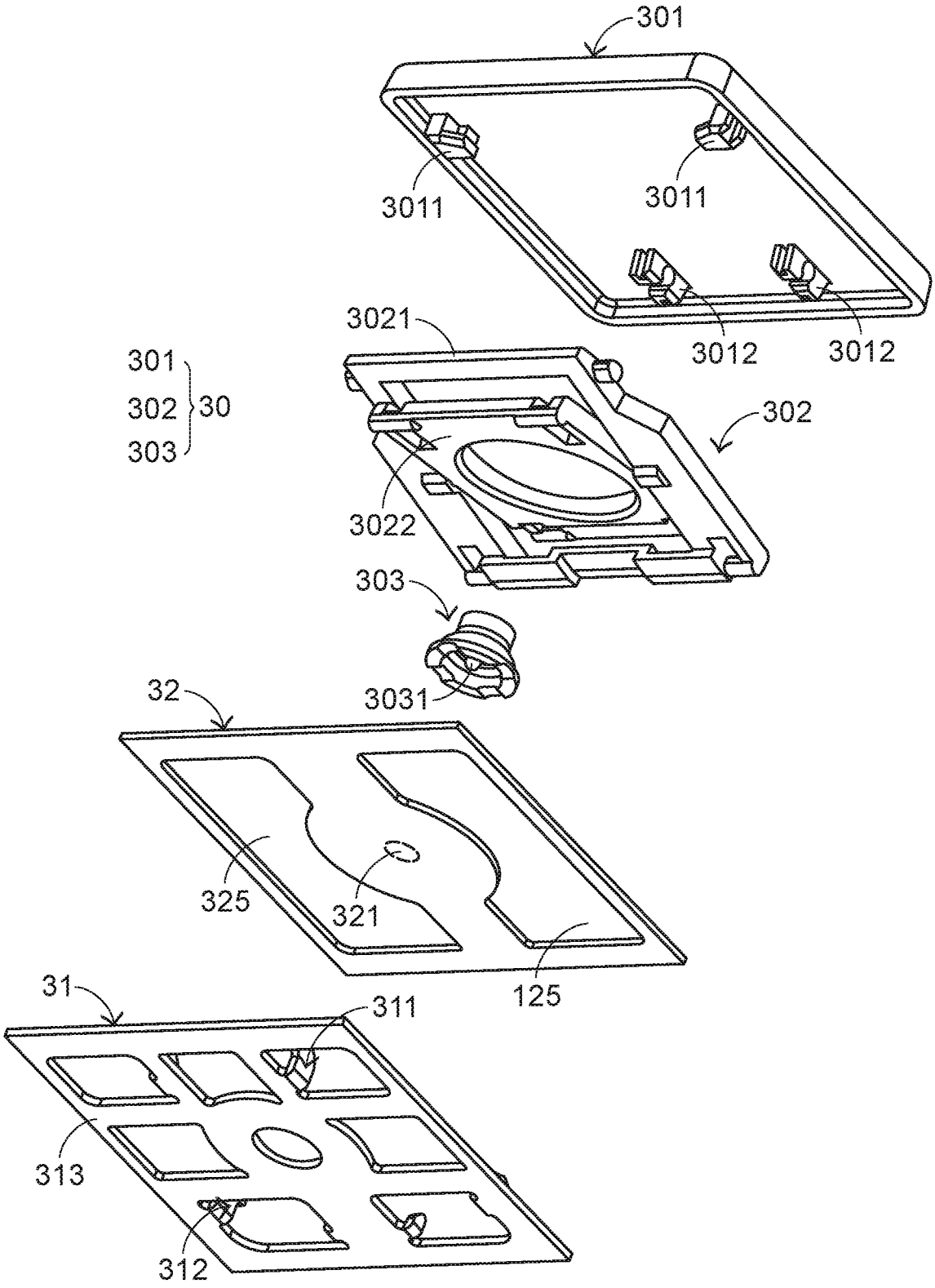
FIG. 8 is a three-dimensional exploded view of a part of a structure of the keyboard device shown in FIG. 6 from any viewing angle.
Figure 9:
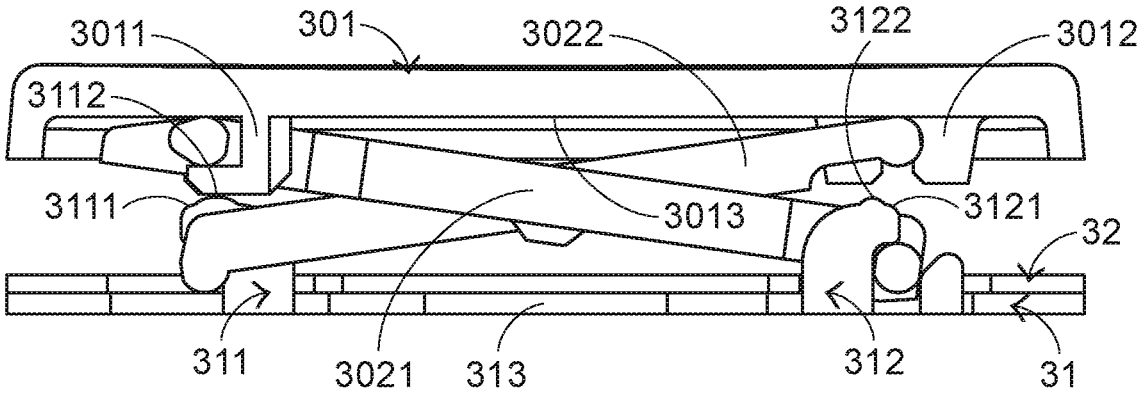
FIG. 9 is a schematic cross-section diagram of a part of a structure of the keyboard device shown in FIG. 6.

Referring to FIG. 6 to FIG. 9, FIG. 6 is a schematic diagram of an appearance structure of a keyboard device in a first preferred embodiment according to the present invention; FIG. 7 is a schematic three-dimensional exploded diagram of a part of a structure of the keyboard device shown in FIG. 6; FIG. 8 is a three-dimensional exploded view of a part of a structure of the keyboard device shown in FIG. 6 from any viewing angle; FIG. 9 is a schematic cross-section diagram of a part of a structure of the keyboard device shown in FIG. 6. For clearness, only one key and/or related component structures are shown in FIG. 6 to FIG. 9 and FIG. 10 and FIG. 11 in the following, but the quantity does not impose a limitation in an actual application. The keyboard device 3 includes a plurality of keys 30, key bottom plates 31, and thin film circuit boards 32. These keys 30 may be classified into common keys, digital keys, functional keys, and the like and respectively allow a user to press with fingers, so that the keyboard device 3 generates a corresponding key signal and inputs the key signal to a computer (not shown in the figure), so that the computer executes a corresponding function. For example, the common key is used to input characters such as English letters, the digital key is used to input numbers, and the functional key, such as F1 to F12, is used to provide various shortcuts.

Secondly, each key 30 includes a keycap 301, a connection component 302, and an elastomer 303, and the connection component 302 is connected between the keycap 301 and the key bottom plate 31, so that the keycap 301 can vertically move relative to the key bottom plate 31. The elastomer 303 is disposed between the keycap 301 and the key bottom plate 31 and has an abutting portion 3031. Each keycap 301 includes a first keycap connection portion 3011 and a second keycap connection portion 3012, and the connection component 302 is a scissors-type connection component and includes a first frame 3021 and a second frame 3022 pivotally connected to the first frame 3021. The first frame 3021 is an outer frame, and the second frame 3022 is an inner frame.

Thirdly, the thin film circuit board 32 includes a plurality of thin film switches 321 and a plurality of thin film penetrating holes 325. The key bottom plate 31 is disposed below the thin film circuit board 32 and includes a base plate 313, a first bottom plate connection portion 311, and a second bottom plate connection portion 312, and the first bottom plate connection portion 311 and the second bottom plate connection portion 312 both extend upward from the base plate 313 and penetrate the thin film penetrating hole 325 of the thin film circuit board 32. The first bottom plate connection portion 311 has a first connection portion surface 3111 corresponding to a lower surface of the keycap 301 and a first raised portion 3112 formed on the first connection portion surface 3111 and raised towards a direction of the keycap 301. The second bottom plate connection portion 312 has a second connection portion surface 3121 corresponding to the lower surface of the keycap 301 and a second raised portion 3122 formed on the second connection portion surface 3121 and raised towards the direction of the keycap 301.

In addition, two ends of the first frame 3021 are respectively connected to the first keycap connection portion 3011 and the second bottom plate connection portion 312, and two ends of the second frame 3022 are respectively connected to the second keycap connection portion 3012 and the first bottom plate connection portion 311. Based on the foregoing structural design, the first frame 3021 and the second frame 3022 can swing relative to each other to be converted from a superimposed state to a separated state or from a separated state to a superimposed state. In this preferred embodiment, the first keycap connection portion 3011 and the second keycap connection portion 3012 are respectively buckle-shaped and hook-shaped, and the first bottom plate connection portion 311 and the second bottom plate connection portion 312 are both hook-shaped, but this does not impose a limitation.

Figure 10:
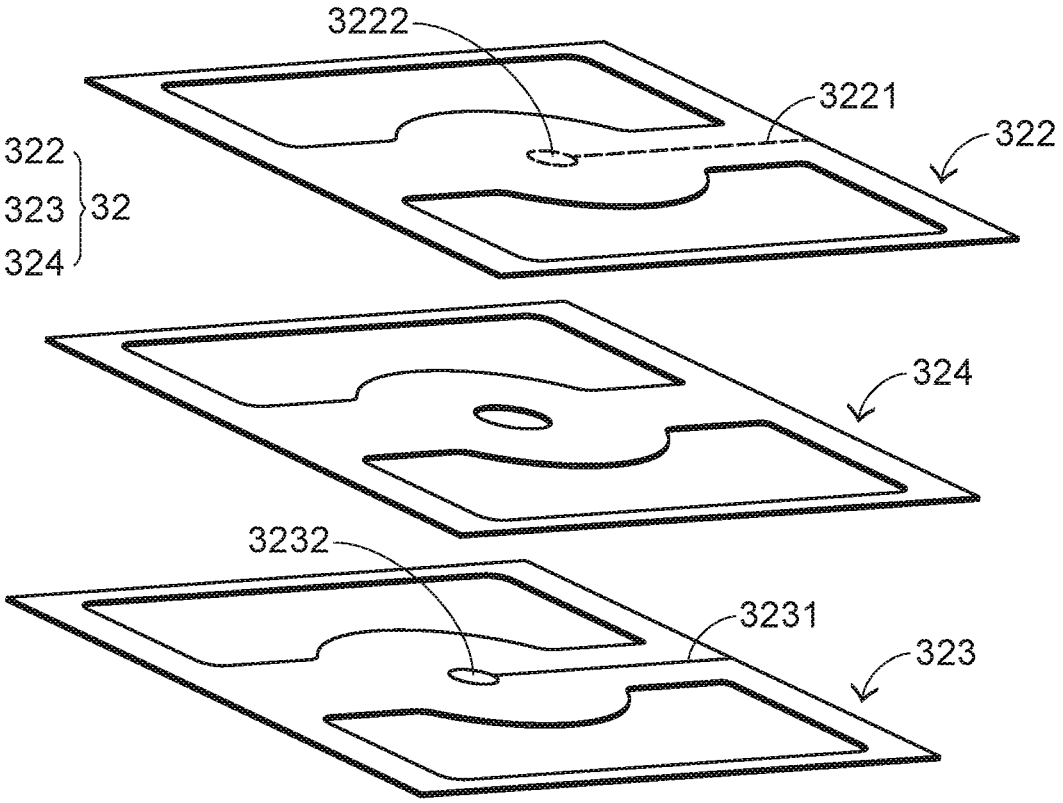
FIG. 10 is a schematic three-dimensional exploded diagram of a part of a structure of a thin film circuit board of the keyboard device shown in FIG. 6.

Referring to FIG. 10 as well, FIG. 10 is a schematic three-dimensional exploded diagram of a part of a structure of a thin film circuit board of the keyboard device shown in FIG. 6. In this preferred embodiment, the thin film circuit board 32 further includes an upper-layer thin film 322 and a lower-layer thin film 323. A lower surface of the upper-layer thin film 322 has a first circuit pattern 3221, and a plurality of upper contacts 3222 respectively corresponding to the plurality of keys 30 is provided on the first circuit pattern 3221. A second circuit pattern 3231 is provided on an upper surface of the lower-layer thin film 323, and a plurality of lower contacts 3232 respectively corresponding to the plurality of upper contacts 3222 is provided on the second circuit pattern 3231. Each upper contact 3222 and a corresponding lower contact 3232 have a gap distance and together form a thin film switch 321. To make each upper contact 3222 and a corresponding lower contact 3232 have a gap distance, the thin film circuit board 32 further includes an intermediate-layer thin film 324, disposed between the upper-layer thin film 322 and the lower-layer thin film 323, and the intermediate-layer thin film 324 has a plurality of contact holes 3241 respectively corresponding to the plurality of upper contacts 3222 and the plurality of lower contacts 3232. This is preferred but does not impose a limitation. Any one of the upper-layer thin film 322, the lower-layer thin film 323, and the intermediate-layer thin film 324 may be made of a polycarbonate (PC) material, a polyethylene terephthalate (PET) material, an acrylic plastic (PMMA) material, a polyurethane (PU) material, or a polyimide (PI) material.

Figure 11:
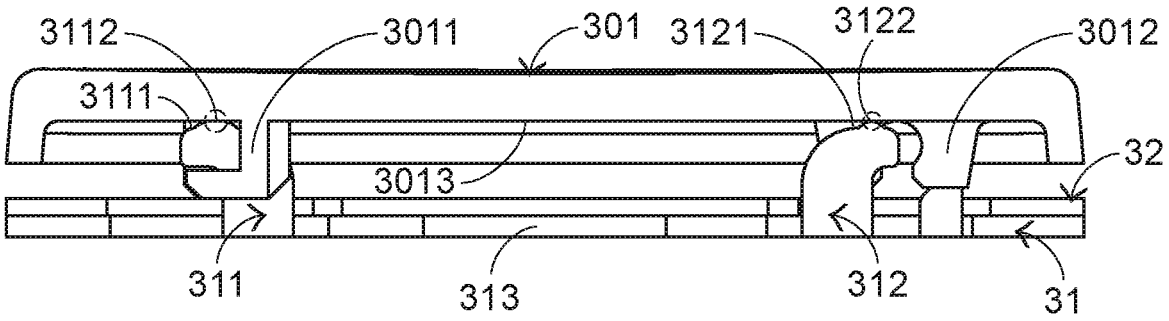
FIG. 11 is a schematic cross-section diagram of a part of a structure of the keyboard device shown in FIG. 6 after the keyboard device is pressed by a keycap.

Referring to FIG. 11 as well, FIG. 11 is a schematic cross-section diagram of a part of a structure of the keyboard device shown in FIG. 6 after the keyboard device is pressed by a keycap. When a keycap 301 of any key 30 is pressed to move downward relative to the key bottom plate 31, the first frame 3021 and the second frame 3022 of the connection component 302 change from the separated state to the superimposed state, and the keycap 301 moving downward extrudes the elastomer 303, so that an abutting portion 3031 of the elastomer 303 abuts against and presses a corresponding upper contact 3222, so that the corresponding upper contact 3222 contacts with a corresponding lower contact 3232 via a corresponding contact hole 3241, so as to make a corresponding thin film switch 321 electrically conducted, so that the keyboard device 3 generates a corresponding key signal. When the keycap 301 of the key 30 is no longer pressed, the keycap 301 moves upward relative to the key bottom plate 31 due to an elastic force of the elastomer 303. In this case, the first frame 3021 and the second frame 3022 change from the superimposed state to the separated state, and the keycap 301 recovers to an original position.

It should be noted that in a process that the keycap 301 of the key 30 is pressed, a lower surface 3013 of the keycap 301 impacts the first bottom plate connection portion 311 and the second bottom plate connection portion 312 of the key bottom plate 31 to make a knocking sound. Because the first bottom plate connection portion 311 forms a first raised portion 3112 raised towards the direction of the keycap 301 on the first connection portion surface 3111 corresponding to the lower surface of the keycap 301, and the second bottom plate connection portion 312 forms a second raised portion 3122 raised towards the direction of the keycap 301 on the second connection portion surface 3121 corresponding to the lower surface of the keycap 301, after the keycap 301 is pressed, the lower surface 3013 of the keycap 301 and the first bottom plate connection portion 311 and the second bottom plate connection portion 312 are knocked in a form of point contact. That is, the lower surface 3013 of the keycap 301 knocks the first raised portion 3112 on the first connection portion surface 3111 and the second raised portion 3122 on the second connection portion surface 3121 but does not knock a whole surface of the first connection portion surface 3111 and a whole surface of the second connection portion surface 3121, as shown in dashed line boxes in FIG. 11. Therefore, a relatively prominent knocking audio can be generated, so as to satisfy operation feedback of users.

Only preferred embodiments of the present invention are described in the above and are not intended to limit the claims of the present invention. Therefore, any other equivalent change or modification accomplished without departing from the spirit disclosed in the present invention shall all fall within the claims of this application.

What is claimed is:

1. A keyboard device, comprising:

a thin film circuit board, comprising a thin film switch;

a key, comprising:

a keycap, located above the thin film circuit board and comprising a first keycap connection portion and a second keycap connection portion, wherein the keycap is used to move downward relative to the thin film circuit board so as to conduct the thin film switch; and a connection component, comprising a first frame and a second frame used to swing relative to the first frame, wherein one end of the first frame is connected to the first keycap connection portion, and one end of the second frame is connected to the second keycap connection portion; and a key bottom plate, comprising a base plate, a first bottom plate connection portion, and a second bottom plate connection portion, wherein the first bottom plate connection portion extends upward from the base plate and is used to connect to the other end of the second frame, and the second bottom plate connection portion extends upward from the base plate and is used to connect to the other end of the first frame;

the first bottom plate connection portion has a first connection portion surface and a first raised portion, the first connection portion surface configured to contact a lower surface of the keycap, and the first raised portion is formed on the first connection portion surface, so that when the keycap moves downward relative to the thin film circuit board, the lower surface of the keycap knocks the raised portion, wherein the second bottom plate connection portion has a second connection portion surface and a second raised portion, the second connection portion surface configured to contact the lower surface of the keycap, and the second raised portion is formed on the second connection portion surface and abuts against the lower surface of the keycap when the keycap moves downward relative to the thin film circuit board.

2. The keyboard device according to claim 1, wherein the base plate of the key bottom plate is disposed below the thin film circuit board.

3. The keyboard device according to claim 2, wherein the thin film circuit board further comprises at least one thin film penetrating hole, the first bottom plate connection portion is connected to the other end of the second frame after penetrating the at least one thin film penetrating hole, and the second bottom plate connection portion is connected to the other end of the first frame after penetrating the at least one thin film penetrating hole.

4. The keyboard device according to claim 1, wherein the first bottom plate connection portion and the second bottom plate connection portion are hook-shaped.

5. The keyboard device according to claim 1, wherein one of the first keycap connection portion and the second keycap connection portion is hook-shaped, and the other of the first keycap connection portion and the second keycap connection portion is buckle-shaped.

6. The keyboard device according to claim 1, wherein the thin film circuit board further comprises an upper-layer thin film and a lower-layer thin film, a first circuit pattern is disposed on the upper-layer thin film, and a second circuit pattern is disposed on the lower-layer thin film; the first circuit pattern and the second circuit pattern separately have an upper contact and a lower contact, and the upper contact and the lower contact have a gap distance and together form the key switch.

7. The keyboard device according to claim 6, wherein the key further comprises an elastomer, disposed between the keycap and the thin film circuit board; when the keycap is pressed, the elastomer is compressed to abut against the thin film switch, so that the upper contact and the lower contact are conducted, and when the keycap is no longer pressed, the elastomer provides an elastic force to the keycap to recover the keycap to an original position.

8. The keyboard device according to claim 6, wherein the thin film circuit board further comprise an intermediate-layer thin film, disposed between the lower-layer thin film and the upper-layer thin film, so that the upper contact and the lower contact has the gap distance.

9. The keyboard device according to claim 1, wherein the first frame and the second frame are respectively an outer frame and an inner frame.

* * * * *